US007532102B2

(12) United States Patent
Lu

(10) Patent No.: US 7,532,102 B2
(45) Date of Patent: May 12, 2009

(54) FUSE CAP FOR A BLADE FUSE

(75) Inventor: Yuan-Feng Lu, Chang Hwa (TW)

(73) Assignee: K.S. Terminals, Inc., Chang Hwa (TW)

( * ) Notice: Subject to any disclaimer, the term of this patent is extended or adjusted under 35 U.S.C. 154(b) by 261 days.

(21) Appl. No.: 11/524,243

(22) Filed: Sep. 21, 2006

(65) Prior Publication Data

US 2008/0007386 A1 Jan. 10, 2008

(30) Foreign Application Priority Data

Jul. 5, 2006 (TW) ..... 95124558 A

(51) Int. Cl.
*H01H 85/143* (2006.01)
*H01H 85/165* (2006.01)

(52) U.S. Cl. ..... 337/191; 337/198; 337/251; 337/268; 337/269; 439/775; 439/890; 439/849; 439/850

(58) Field of Classification Search ..... 337/187, 337/191–193, 248, 198, 251, 268, 269; 439/775, 439/890, 849, 850, FOR. 101, FOR. 102
See application file for complete search history.

(56) References Cited

U.S. PATENT DOCUMENTS 3,126,242 A 3/1964 Herman
4,372,638 A 2/1983 Sohler
4,724,606 A 2/1988 Secton, Jr.
4,789,361 A 12/1988 Kinzalow et al.
4,827,238 A 5/1989 Kozel
4,830,631 A 5/1989 Hsueh
4,884,050 A 11/1989 Kozel
4,941,851 A 7/1990 Hsueh
4,943,248 A 7/1990 Colleran et al.
4,968,264 A 11/1990 Ruehl et al.
4,981,448 A 1/1991 Herbert
4,986,767 A 1/1991 Kozel
5,082,452 A * 1/1992 Takano ..... 439/206
5,239,282 A 8/1993 Filomia
5,324,214 A 6/1994 De Castro
5,345,796 A 9/1994 Chieh et al.
5,476,396 A 12/1995 De Castro
5,507,669 A 4/1996 Jannett et al.
5,736,918 A 4/1998 Douglass
5,882,229 A 3/1999 Caren et al.
5,963,123 A 10/1999 Douglass
6,407,657 B1 * 6/2002 Oh ..... 337/197
6,507,265 B1 1/2003 Ackermann
6,664,886 B2 12/2003 Ackermann
6,702,595 B2 * 3/2004 Nelson et al. ..... 439/83
D494,933 S * 8/2004 Lu ..... D13/133
6,850,421 B2 2/2005 Boyd
6,878,004 B2 * 4/2005 Oh ..... 439/250
7,086,912 B2 * 8/2006 Matsuura et al. ..... 439/845

* cited by examiner

*Primary Examiner*—Anatoly Vortman
(74) *Attorney, Agent, or Firm*—Ming Chow; Sinorica, LLC

(57) ABSTRACT

The blade fuse comprises a fuse body, a pair of significantly parallel blades connecting the fuse body and partially extending thereof to form electric connections, and a blade box for receiving the fuse body and the parallel blades.

7 Claims, 4 Drawing Sheets

FUSE CAP FOR A BLADE FUSE

BACKGROUND OF THE INVENTION

As more and more cars are equipped with alarm systems, navigation systems and video/audio systems, consumers need to cut off the power when entering the automobile electronic system to protect the automobile circuitry. In many circumstances, it is difficult to connect to the battery directly through wiring, and thus, blade fuse is commonly used in the electronic systems of automobiles.

Conventionally, a blade fuse includes a pair of parallel blades and a blade box. The blades are received within the blade box, and a portion of the blades is extended outwardly from the blade box acting as a connection. The exposed connection may encounter undesired contact due to car vibration or oxidation of the exposed connection because there's no device to completely secure the blade fuse with the electric connector. In view of the disadvantages of the conventional blade fuse, U.S. Pat. No. 5,882,229 developed a fuse cap that can provide a good electrical contact between the electrical connector and the blade connection of the blade fuse. As shown in FIG. 1, the fuse cap 50 includes a strip body 51; one end of the strip body 51 is connected to an electrically coupled end of a conducting wire; a cap flange 53 formed on the other end of the strip body 51, and teeth blades 58 that are arranged in double lines and engaged to each other are provided within the cap flange 53 so as to tightly engage the connection through the double lines of the teeth blade 58. However, the characteristics of the prior art are to form a neck portion 55 extended outwardly on the strip body 51 so that the neck portion 55 and the cap flange 53 are clamped to the upper edge and the lower edge of the blade box respectively (not shown), thereby achieving stability and preventing bad electrical contacts or short circuit due to the vibration of the car.

FIELD OF THE INVENTION

The present invention relates to a connecting component for a fuse; more particularly, the present invention relates to a fuse cap used for a blade fuse in electronic components for automobiles.

SUMMARY OF THE INVENTION

The blade fuse includes a fuse body, a pair of significantly parallel blades connecting the fuse body and partially extending thereby to form electric connections, and a blade box for receiving the fuse body and the parallel blades. having an opening for receiving the electric connections of the blades and at least one tooth within a single side of the opening to tightly clamp with the electric connections of the blades. The fuse cap used for the blade fuse is further characterized in that a locking element is formed with a predetermined distance from the cap flange on the body portion. Wherein, at least a pair of opposite or offset clamping portions is formed on both lateral sides of the locking element, which makes the blade fuse to be tightly secured to the fuse cap.

The fuse cap of the present invention is formed with a single metal piece. Not only does the fuse cap not need any additional element to secure itself tightly with the connecting portion so as to prevent blade fuse in use from unstable electric connection due to automobile vibration, but also at least one pair of opposite or offset clamping portions formed on both lateral sides of the locking element can enhance the extensible resistance of the metal on the sides of the locking element to prevent it from deformation after usage, thereby extending the life time of the fuse. Therefore, the present invention not only reduces the cost, but greatly increases the protection for the circuitry.

DETAILED DESCRIPTION OF THE PREFERRED EMBODIMENTS

The present invention discloses a fuse cap structure of a blade fuse used in an automobile. The following figures are not illustrated in actual proportion and are only meant to describe the characteristics of the present invention.

Figure 1:
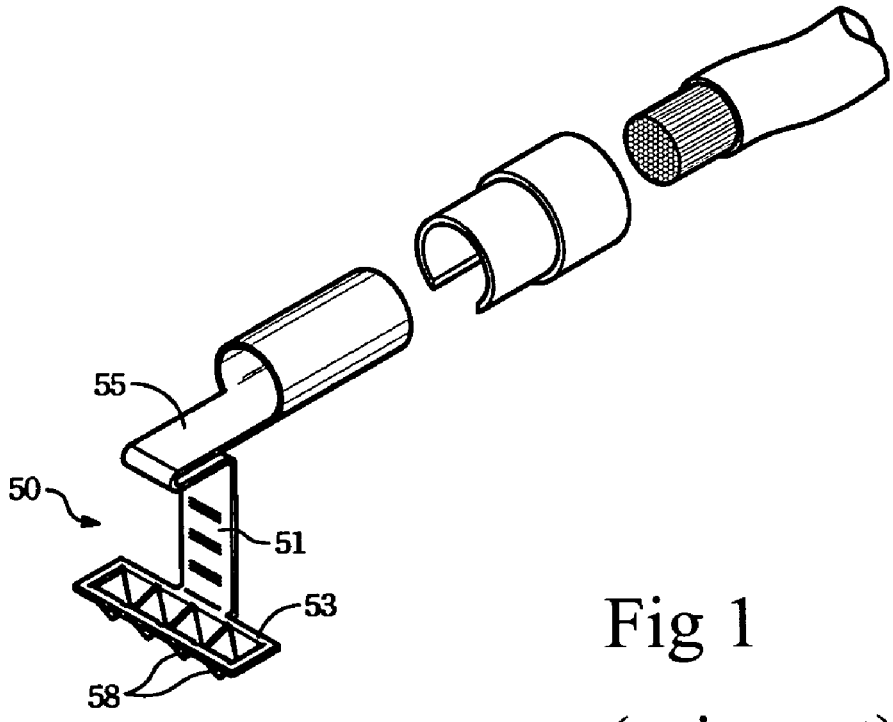
Fig 1 (prior art)
FIG. 1 is a three-dimensional view of the conventional fuse cap.
Figure 2:
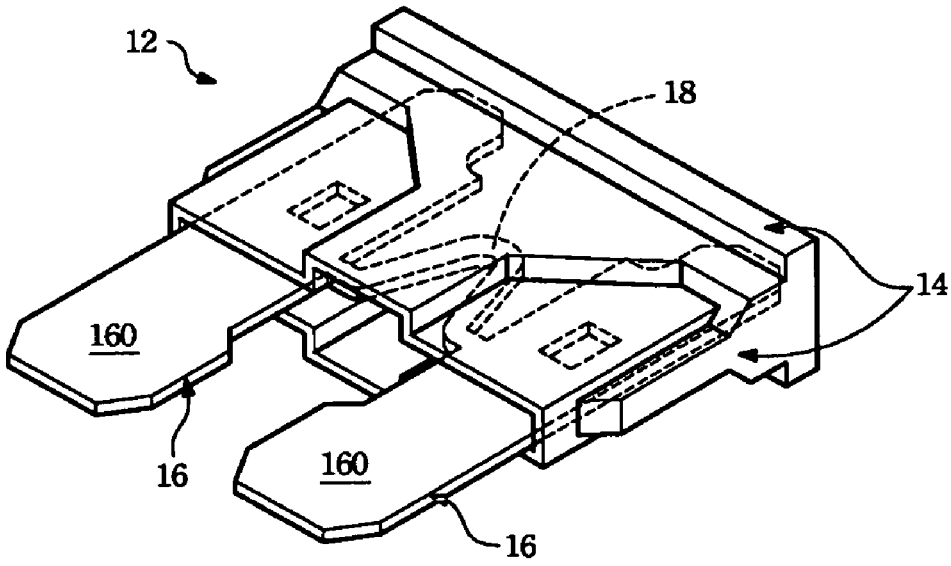
FIG. 2 is a three-dimensional view of the conventional blade fuse.

FIG. 2 illustrates the perspective view of the conventional blade fuse 12 prior to inserting the fuse cap 10 of the present invention. As shown, the blade fuse 12 is externally covered by the blade box 14, a pair of parallel arranged blades 16 is received within the blade box 14, a fuse body 18 is connected between the two blades 16; a portion of the blade 16 is extended from the blade box 14 acting as the connection 160; the blade fuse 12 is a prior art and will not be described in details herein. However, the blade fuse 12 is secured in the automobile or at a predetermined position in other mobile electronic devices with at least one fuse cap 10 disclosed in each of the embodiments in accordance with the present invention so as to be electronically connected to an electrically connecting wire or other electrical connecting terminals (not shown in figures).

Figure 3:
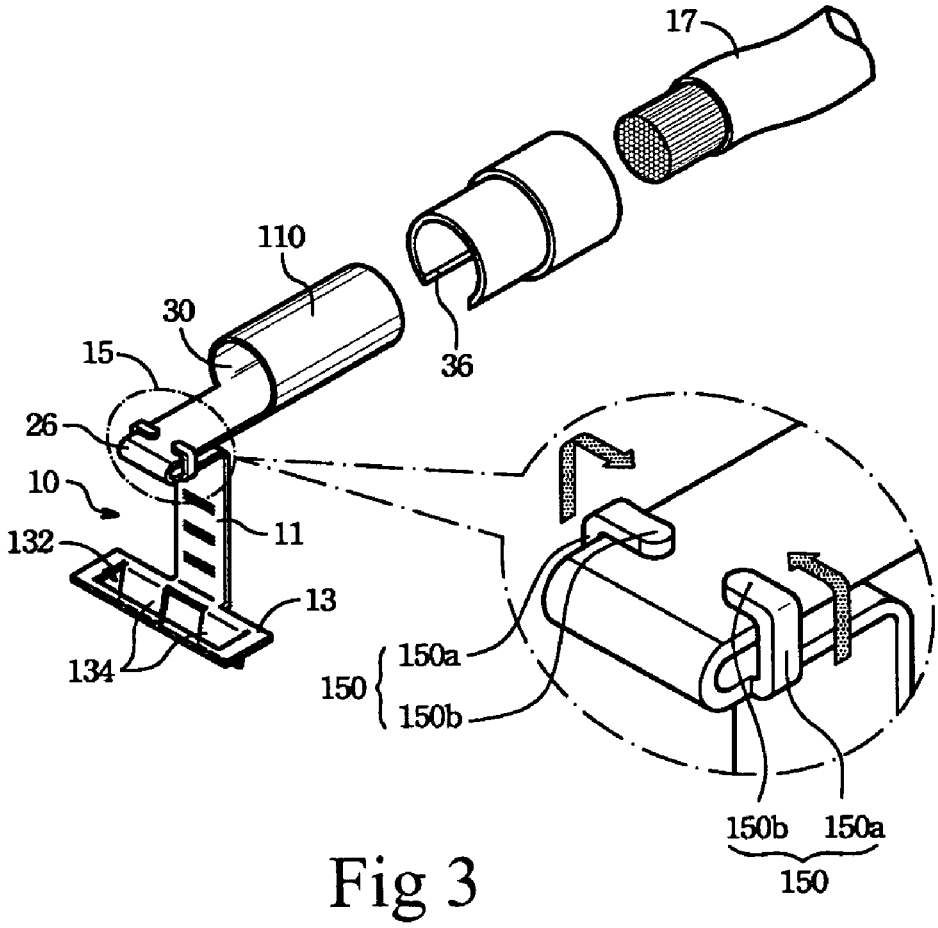
FIG. 3 is a three-dimensional view of the first embodiment of the fuse cap of the present invention and a partial enlargement view.
Figure 4:
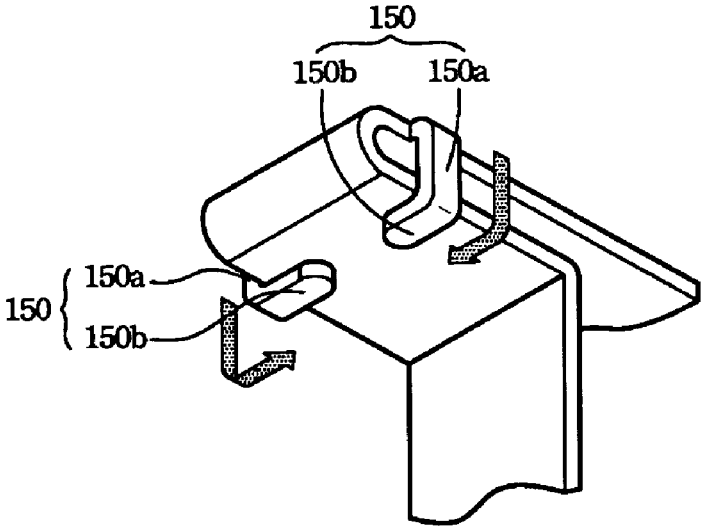
FIG. 4 is a partial three-dimensional view of the first embodiment of the fuse cap of the present invention.
Figure 5:
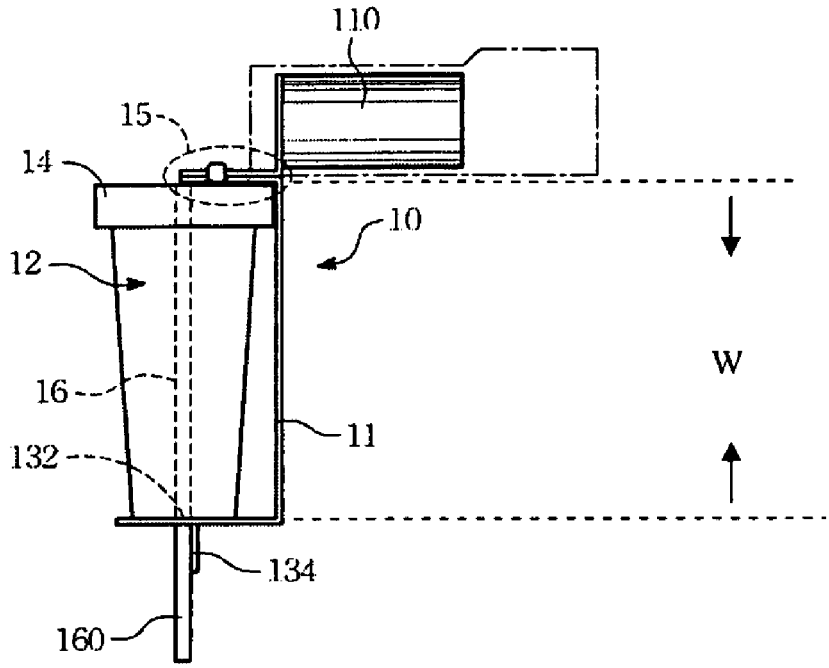
FIG. 5 is a longitudinal perspective view of the first embodiment of the fuse cap of the present invention.

FIGS. 3 to 5 each disclose a three-dimensional view of the fuse cap of the first embodiment of the present invention. As shown in FIG. 3, the fuse cap 10 includes a strip body 11, a cap flange 13 integrally formed with the strip body 11, and a locking element 15, wherein a solder connector 110 is formed on one end of the strip body 11 so as to be soldered and electrically connected with an electrically connecting wire 17 or other electrical connecting terminals. The other end of the strip body 11 is connected to the cap flange 13. Wherein, an opening 132 is within A plurality of teeth 134 are formed along the perimeter on one side of the opening 132 and extended from one side of the opening 132 outwardly; the teeth 134 are formed by extensible metal materials such as copper, brass, or aluminum and other alloys; the shape of the teeth 134 can be discontinuous teeth, continuous teeth, curved teeth, rectangular teeth, triangular teeth or other forms.

Then, a locking element 15 is integrally formed between the solder connector 110 and the cap flange 13 on the strip body 11 of the fuse cap 10 of the present invention with a predetermined distance W from the cap flange 13. As shown in FIGS. 3, 4 and 5, the locking element 15 is a curved or a gooseneck portion so as to be tightly secured at the edge of the blade box 14 with the blade fuse 12. Wherein, the predetermined distance W of the locking element 15 from the cap flange 13 is substantially similar to the height of the blade box 14, thereby when the fuse cap 10 is inserted into the blade fuse 12, the predetermined distance W can completely receive the blade box 14. Additionally, the two sides of the locking element 15 are formed with a pair of opposite clamping portions 150; each clamping portion 150 is integrally formed by the base 150*a* and the cover end 150*b* connecting to each other. The length of the clamping portion 150, namely the total length of the base 150*a* and the cover end 150*b*, needs to be greater than the thickness of the sides of the locking element 15 after they are bent. However, after the base 150*a* of the clamping portion 150 is extended outwardly from the locking element 15, it will be bent from bottom to top along the side of the locking element 15 (as shown by the arrow in FIG. 3) or from top to bottom (as shown by the arrow in FIG. 4), then the cover end 150*b* will press the surface on the other side of the locking element 15 so that the side of the locking element 15 is completely engaged by the clamping portion 150. Therefore, the two sides of the locking element 15 adding the clamping portion 150 can help enhance the extensible resistance of the metal at the sides of the locking element 15 to prevent the locking element 15 from deformation after frequent use that would further cause the blade fuse to come off easily when the automobile vibrates.

Figure 6:
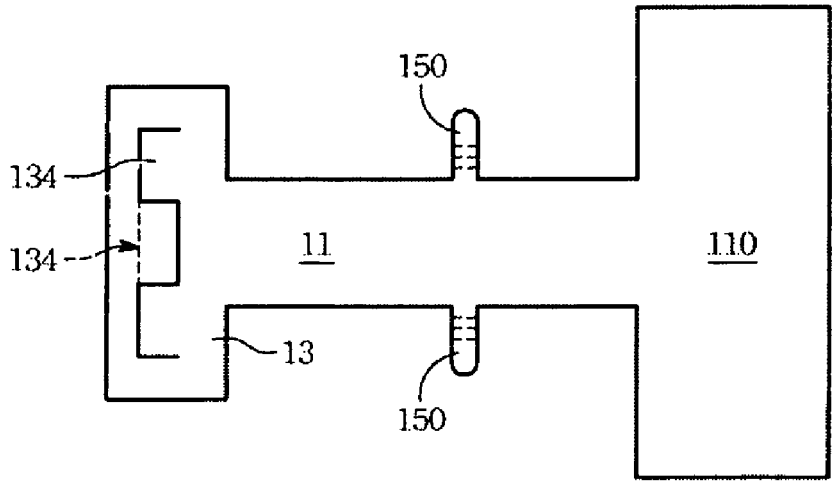
FIG. 6 is an upper view of the non-completed product of the fuse cap before molding of the present invention.

FIG. 6 illustrates the schematic view of the half product of the first embodiment of the fuse cap in accordance with the present invention. As shown, the half product of the fuse cap 10 before molding is formed by a metal strip body 11; the material thereof can be of copper, brass, aluminum or other metal alloys. One end of the metal strip body 11 is formed with a cylindrically curved solder connector 110 so as to fill in solder materials for the core of the connector to solder. The other end of the strip body 11 is positioned with a cap flange 13. Wherein, an opening 132 is in the cap flange 13 and a single side of the perimeter of the opening 132 is formed with a plurality of teeth 134. The teeth 134 are formed by extensible metal materials such as copper, brass, or aluminum and other alloys; the shape of the teeth 134 can be continuous teeth, discontinuous teeth, curved teeth, rectangular teeth or triangular teeth. When the connection (see 160 in FIG. 5) of the blade fuse passes through the opening 132, the slightly extensible teeth 134 will tightly clamp the connection 16 so as to form a good electrical contact.However, the main characteristics of the present invention are that a locking element 15 is integrally formed with a predetermined distance W from the cap flange 13 between the solder connector 110 and the cap flange 13 on the strip body 11. The two sides of the neck are formed with at least one pair of the opposite clamping portion 150. The length of each clamping portion 150 is greater than the thickness of the side of the locking element 15 after they are bent.

Figure 7:
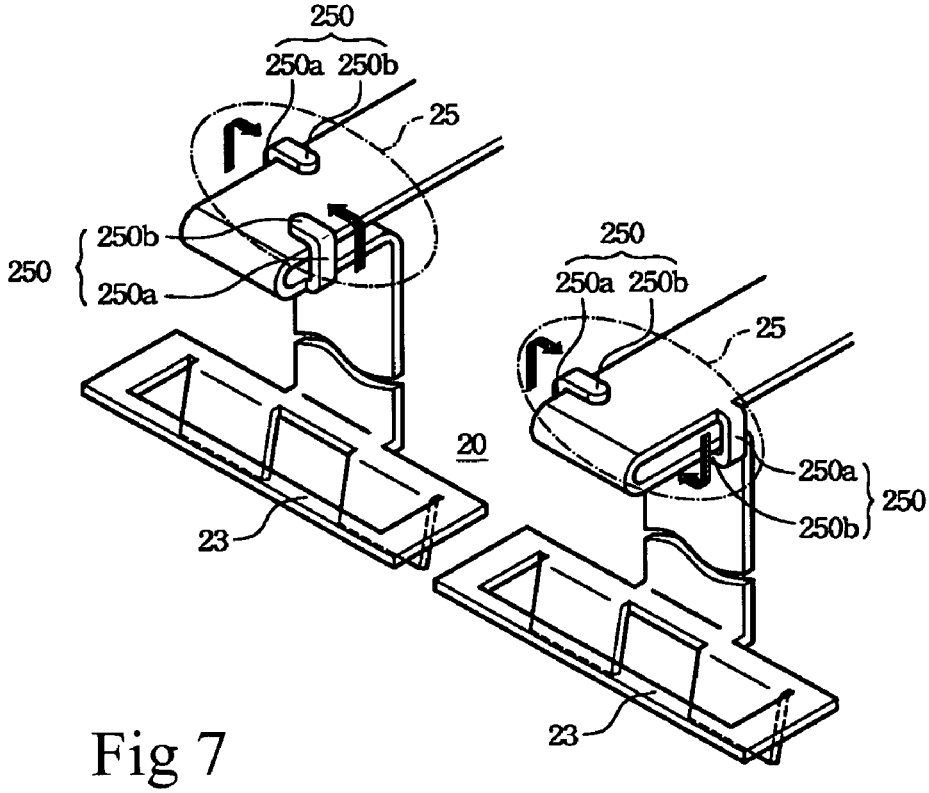
FIG. 7 is a partial three-dimensional view of the second embodiment of the fuse cap of the present invention.

FIG. 7 is the second embodiment of the fuse cap of the present invention. The second embodiment of the present invention is similar to the aforesaid first embodiment; however, the difference is in the clamping portion of the locking element. As shown in FIG. 7, in the second embodiment of the fuse cap of the present invention, the locking element 25 is a curved portion or a gooseneck portion, so as to tightly secure at the edge of the blade box (as shown by 14 of the previous embodiment in FIG. 5) with the blade fuse (as shown by 12 of the previous embodiment in FIG. 5). Wherein, the predetermined distance of the locking element 25 from the cap flange 23 is substantially similar to the height of the blade box. When a fuse cap 20 of the second embodiment of the present invention is inserted into the blade fuse (not shown), the predetermined distance can completely receive the blade box of the blade fuse. Additionally, the two sides of the locking element 25 are formed with at least one pair of the offset clamping portion 250; each clamping portion 250 is integrally formed by the base 250*a* and the cover end 250*b* connecting to each other, and the length of the clamping portion 250 must be greater than the thickness of the side of the locking element 25 after they are bent. As shown by the arrow in FIG. 7, the two cover ends 250*b* of the paired offset clamping portion 250 are positioned in the same direction (both curved from bottom to top or both curved from top to bottom) or positioned in the opposite direction (curved one from top and one from bottom) and formed on the two sides of the locking element 25.

As mentioned in the previous embodiment, the two sides of the locking element are formed with at least one pair of the opposite clamping portion or the offset clamping portion so as to strengthen the secure engagement of the blade connection between the fuse cap and the blade fuse; the third and fourth embodiments of the present invention further provide novel design on the cap flange.

Figure 8:
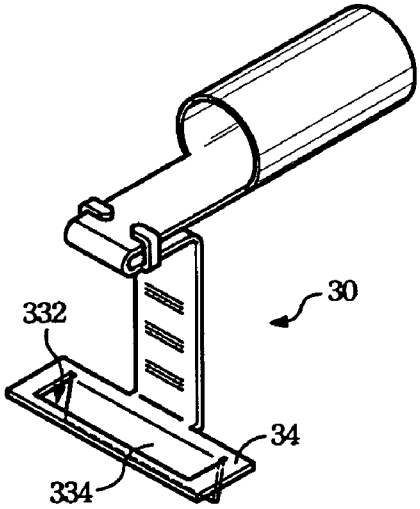
FIG. 8 is a three-dimensional view of the third embodiment of the fuse cap of the present invention.
Figure 9:
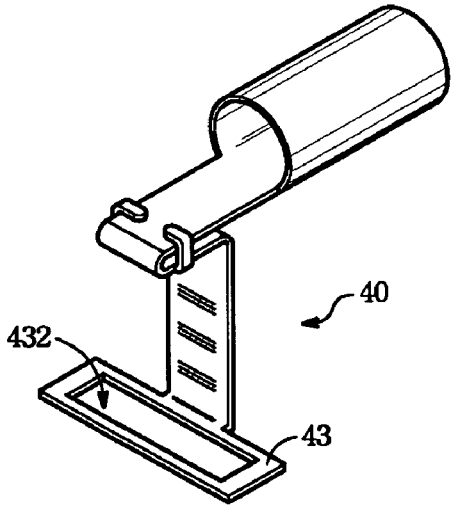
FIG. 9 is a three-dimensional view of the fourth embodiment of the fuse cap of the present invention.

FIGS. 8 and 9 illustrate the three-dimensional views of the third embodiment and the fourth embodiment of the fuse cap of the present invention respectively. As shown in FIG. 8, a single tooth 334 is extended outwardly from the perimeter of a single side of the opening 332 of the cap flange 33 of the fuse cap 30 and is flatly attached to said blades; or alternatively, as shown in FIG. 9, one or more opening 432 is stamped on the cap flange 43 of the fuse cap 40. Wherein, as shown in FIG. 8, the single tooth 334 of the third embodiment of the present invention can be formed as curved tooth, rectangular tooth, triangular tooth or other shapes of tooth, and the single tooth 334 made with copper, brass, aluminum or any other alloys is also included with the third embodiment of the present invention.

The above mentioned is the preferred embodiments of the present invention. They are not meant to limit the patent right of the present invention; at the same time, the above description is for those skilled in the art to better understand and enable the present invention. Therefore, modifications or changes made to the embodiment do not leave the spirit and scope of the present invention and shall be included by the claims set forth below.

What is claimed is:

1. A fuse cap used for a blade fuse, said blade fuse having a fuse body, a pair of blades formed substantially parallel and connected to said fuse body, and a blade box, said fuse body and blades received in said blade box, and a portion of said blades extended outwardly from said blade box acting as a connection, wherein said fuse cap comprises:

a strip body, one end of said strip body is connected to an electrically coupled end;

a cap flange formed on the other end of said strip body, an opening is provided within said cap flange for receiving said connection of said blades of said blade fuse, a single tooth is extended outwardly from a single side of the perimeter of said opening and flatly attached to said blades so as to tightly engage said connection; and a locking element formed on said strip body away from said cap flange with a predetermined distance so as to tightly secure the edge of the blade box, wherein said predetermined distance is similar to the height of the blade box for receiving the blade box, and two sides of said locking element are formed with at least one pair of opposite clamping portions, said clamping portion is extended outwardly then being bent to clamp said locking element.

2. The fuse cap of claim 1, wherein the length of said clamping portion is greater than the thickness of the sides of said locking element after being bent.

3. The fuse cap of claim 1, wherein said clamping portion is bent from bottom to top.

4. The fuse cap of claim 1, wherein said clamping portion is bent from top to bottom.

5. A fuse cap used for a blade fuse, said blade fuse having a fuse body, a pair of blades substantially parallel and connected to said fuse body, and a blade box, said fuse body and blades received in said blade box, and a portion of said blades extended outwardly from said blade box acting as a connection, wherein said fuse cap comprises:

a strip body, one end of said strip body is connected to an electrically coupled end;

a cap flange formed at the other end of said strip body, an opening is provided within said cap flange for receiving said connection of said blades of said blade fuse; and a locking element formed on said strip body away from said cap flange with a predetermined distance so as to tightly secure the edge of the blade box, wherein said predetermined distance is similar to the height of the blade box for receiving the blade box, and two sides of said locking element are formed with at least one pair of clamping portion, said clamping portion is extended outwardly then being bent so as to clamp said locking element.

6. The fuse cap of claim 5, wherein said pair of clamping portion is oppositely positioned.

7. The fuse cap of claim 5, wherein the length of said clamping portion is greater than the thickness of sides of said locking element after being bent.

* * * * *